US006623301B2

(12) United States Patent
Lappoehn

(10) Patent No.: US 6,623,301 B2
(45) Date of Patent: Sep. 23, 2003

(54) PLUG CONNECTOR FOR ELECTRONIC DEVICES

(75) Inventor: Juergen Lappoehn, Gammelshausen (DE)

(73) Assignee: Erni Elektroapparate GmbH, Adelberg (DE)

( * ) Notice: Subject to any disclaimer, the term of this patent is extended or adjusted under 35 U.S.C. 154(b) by 0 days.

(21) Appl. No.: 10/127,402

(22) Filed: Apr. 22, 2002

(65) Prior Publication Data

US 2002/0173201 A1 Nov. 21, 2002

(30) Foreign Application Priority Data

Apr. 20, 2001 (DE) ..... 101 19 695

(51) Int. Cl.[7] ..... H01R 13/648
(52) U.S. Cl. ..... 439/607; 429/108
(58) Field of Search ..... 439/83, 109, 607, 439/608

(56) References Cited

U.S. PATENT DOCUMENTS 5,035,631 A * 7/1991 Piorunneck et al. ..... 439/108
5,863,222 A * 1/1999 Kinsey et al. ..... 439/607
6,305,982 B1 * 10/2001 Wu ..... 439/607

FOREIGN PATENT DOCUMENTS

| | | |
|---|---|---|
| DE | 85 17 809.8 | 6/1985 |
| DE | 38 34 182 | 4/1990 |
| DE | 93 11 782.5 | 8/1993 |
| DE | 195 37 530 | 9/1995 |
| DE | 199 07 635 | 2/1999 |
| EP | 0 188 876 | 7/1986 |

* cited by examiner

*Primary Examiner*—Tho D. Ta
*Assistant Examiner*—James R. Harvey
(74) *Attorney, Agent, or Firm*—Collard & Roe, P.C.

(57) ABSTRACT

A plug connector, especially for SMD plugs having plug-connector elements provided with shield plates which shield the electric contacts. The shield plates, in turn, in the coupled condition, bear against one another over substantially their entire area and are fixed with snap fastenings on the respective plug-connector elements. Soldering tabs extend beyond the plug-connector elements and are provided for electrically contacting the shield plates. Preferably SMD leads are formed on the shield plates.

8 Claims, 3 Drawing Sheets

11
5
21
13
3'
27
17
19
26
7'
7
9
24
19
23
1
28
25
15

12
6
4'
4
22
22
14
8'
8
18
20
20
29
2
16

PLUG CONNECTOR FOR ELECTRONIC DEVICES

BACKGROUND

The invention relates to a plug connector, especially for SMD ("surface-mounted device") plugs, for connection of electronic devices.

Plug connectors are known and commonly used in diverse configurations. They have two plug-connector elements, which can be mutually engaged, and they are provided with a plurality of electrically conductive contacts that establish electrically conductive connections. The SMD plug connectors are plugged onto a printed-circuit board and detachably fixed by a snap fastening. Snap-in projections in the form of barbs engage in corresponding snap-in recesses. The plug-connector element disposed on the printed-circuit board can be detachably connected with another plug-connector element of complementary geometry. This permits the printed-circuit board to couple to a multi-conductor cable that has the other plug-connector element at its end.

It is known that the influence of external electromagnetic fields on a plug connector can be reduced by providing a shield plate of electrically conductive material on both plug-connector elements. This configuration also prevents electrical crosstalk in a plug connector. The shield plate surrounds their electrical contacts. These shield plates additionally function automatically as bonding conductors for grounding the plug connector or the printed-circuit board.

Under these conditions the problem of permanent electrical contact of the shield plates arises. This is especially true for plug-connector elements mounted permanently on the printed-circuit boards. In addition, the assembly process is considerably complex when a plug connector is to be equipped with a shield plate. Furthermore, a satisfactory solution has not yet been achieved for the electrical contact of these shield plates with one another.

A person skilled in the art is faced with the object of designing a plug connector with shield plates in such a way that electrically conductive contact of the two shield plates with one another is permanently assured and that the shield plates can be contacted reliably with the associated printed-circuit board.

SUMMARY OF THE INVENTION

The central idea of the present invention is that, during assembly of a plug-connector element, the shield plates are automatically fixed via snap fastenings, so that displacement of the shield plate relative to the plug-connector element is prevented. It is ensured that, when the two plug-connector elements are coupled with one another, the respective shield plates bear directly against one another over substantially their entire surface. In other words, the shield plates are predominantly flush with their body areas facing one another, and do not slip. For this purpose the shield plates are constructed in the form of substantially flat metal components. Furthermore, soldering tags are formed on the shield plates, and project out of or extend beyond the connector-element body, which is usually a plastic injection-molded part. These soldering tags allow the plug-connector element with the shield plate to be permanently contacted with a printed-circuit board using a dip-soldering technique. The soldering tags are additionally used to position and align the shield plates during assembly of the plug-connector element and during plugging of the plug-connector element onto a wiring board. In the process the soldering tags extending beyond the plug-connector element are introduced into corresponding recesses of a wiring board or similar component, whereupon the element is automatically aligned in correct position. In addition, an appropriate retaining force for fastening the element is applied with a subsequently made soldered connection.

The shield plate and the soldering tags of the corresponding plug-connector element are connected in the same way to the bonding conductor of the multi-conductor electrical connecting cable.

Preferably the plug-connector elements are constructed in the form of male and female multipoint connectors in each of which a plurality of electrical contact blades and sockets are disposed. Multipoint connectors generally have a rectangular body. These multipoint connectors are provided with snap-in projections or recesses, into which corresponding snap-in projections or recesses of the correspondingly shaped shield plate can be inserted to form a snap fastening. For this purpose the shield plate is preferably designed so that it comprises a continuous enclosure around the electrical contacts shielding the connection completely. The shield plate is at least along one of the side walls, preferably a long side of the plug-connector element. It can also have multi-piece construction.

To couple the male multipoint connector with the female multipoint connector, the male multipoint connector is provided with a receiving cavity into which the female multipoint connector can be introduced. For this purpose the blades of the male multipoint connector project from the base of the receiving cavity into the receiving cavity, and are contacted by the sockets arrayed in the female multipoint connector. The shield plates on the multipoint connectors are arranged so that the shield plate of the male multipoint connector is directly disposed on the inside of the receiving cavity and bears substantially against the body of the male multipoint connector, or the wall of the injection-molded part surrounding the receiving cavity. Correspondingly, the shield plate of the female multipoint connector is disposed on its exterior peripheral face. In the coupled condition of the two multipoint connectors, the flat and plane regions of the plates, facing one another, bear substantially completely and directly against one another.

To ensure that the two multipoint connectors are correctly positioned when plugged one into the other, guide elements are formed on the multipoint connectors. The guide elements have the form of projections, which extend outward beyond the body of the multipoint connector in plug-in direction and can be inserted into corresponding recesses on the other multipoint connector. This prevents the risk of skewed plugging of the two multipoint connectors and of bending of the blades or sockets.

It is also proposed that corresponding projections for guiding and aligning the multipoint connectors be provided on the shield plates, so that they also have one-piece construction.

To simplify plugging the two multipoint connectors one into the other, the edges or end regions of the shield plates pointing in the plug-in direction, are chamfered or are inclined relative to the body of the shield plate. The edges of the male multipoint connector are directed outward relative to the body and those of the female multipoint connector are directed inward relative to the body. Viewed in cross section, the portions each have symmetrical structure that either flares in the manner of a funnel or tapers in the manner of a pyramid. This facilitates the introduction of the one multipoint connector into the other even if the alignment is not exact.

SMD plug-connector elements or leads are formed on the shield plates. This ensures that the shield plates are contacted and the electrical connections are shielded in the coupled condition. During assembly, therefore, the SMD lead of a shield plate of a plug-connector element is electrically contacted with, the printed-circuit board or wiring board onto which the plug-connector element is plugged.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
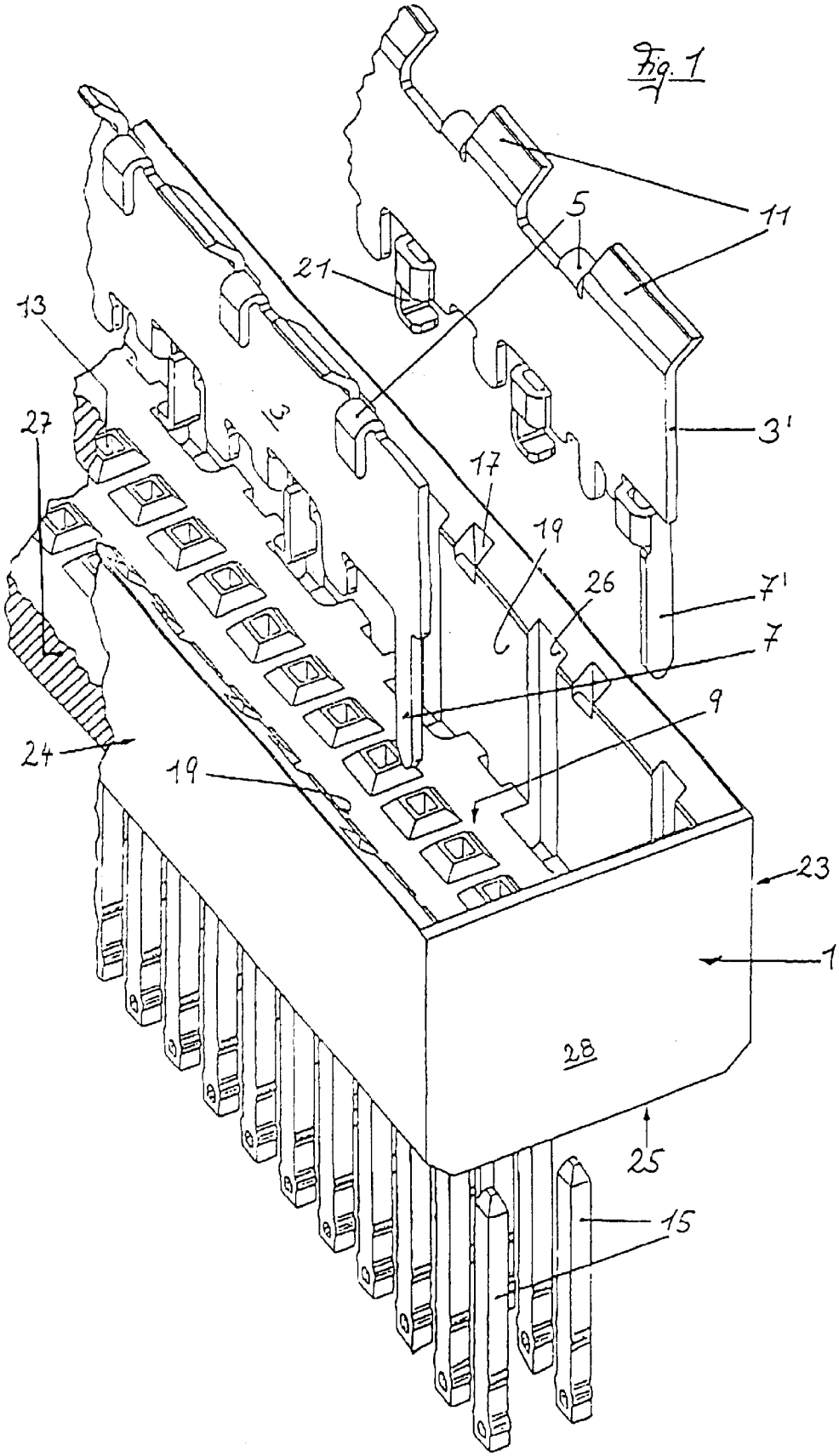
FIG. 1 shows an exploded diagram of a male multipoint connector with shield plate(s)

Referring now in detail to the drawings, male multipoint connector 1 in FIG. 1 comprises a plastic injection-molded part which defines a receiving cavity 9 with side walls 23, 24, two end faces 28 and a bottom 27. Apertures 13 through which electrical contact blades 15 can be guided and preferably fixed via a snap fastening are provided on bottom side 27. Shield plates 3, 3' bear directly against the interior lateral wall portions 19 of receiving cavity 9. On shield plates 3, 3' there are formed soldering tags 7, 7' and SMD lead on 3, which are guided in channels 26 and also extend through the body of male multipoint connector 1 and engage the bottom side at 25. They can be soldered onto a printed-circuit board, for example, not illustrated here. These SMD leads 21 are used for contacting in an SMD plug connection.

Furthermore, snap-in devices, here in the form of hook-like projections 5, are formed on shield plates 3, 3' in such a way that they can be engaged in corresponding recesses 17 in male multipoint connector 1. Therefore, it is ensured that shield plates 3, 3' can be fixed relative to male multipoint connector 1, thus preventing relative movement between the two components.

Inclined projections 11, in this case extending outwardly, are formed on shield plates 3, 3', preferably as a one-piece construction. When male multipoint connector 1 is viewed in cross section longitudinally, a funnel-shaped configuration that assists introduction is formed by projections 11.

Figure 2:
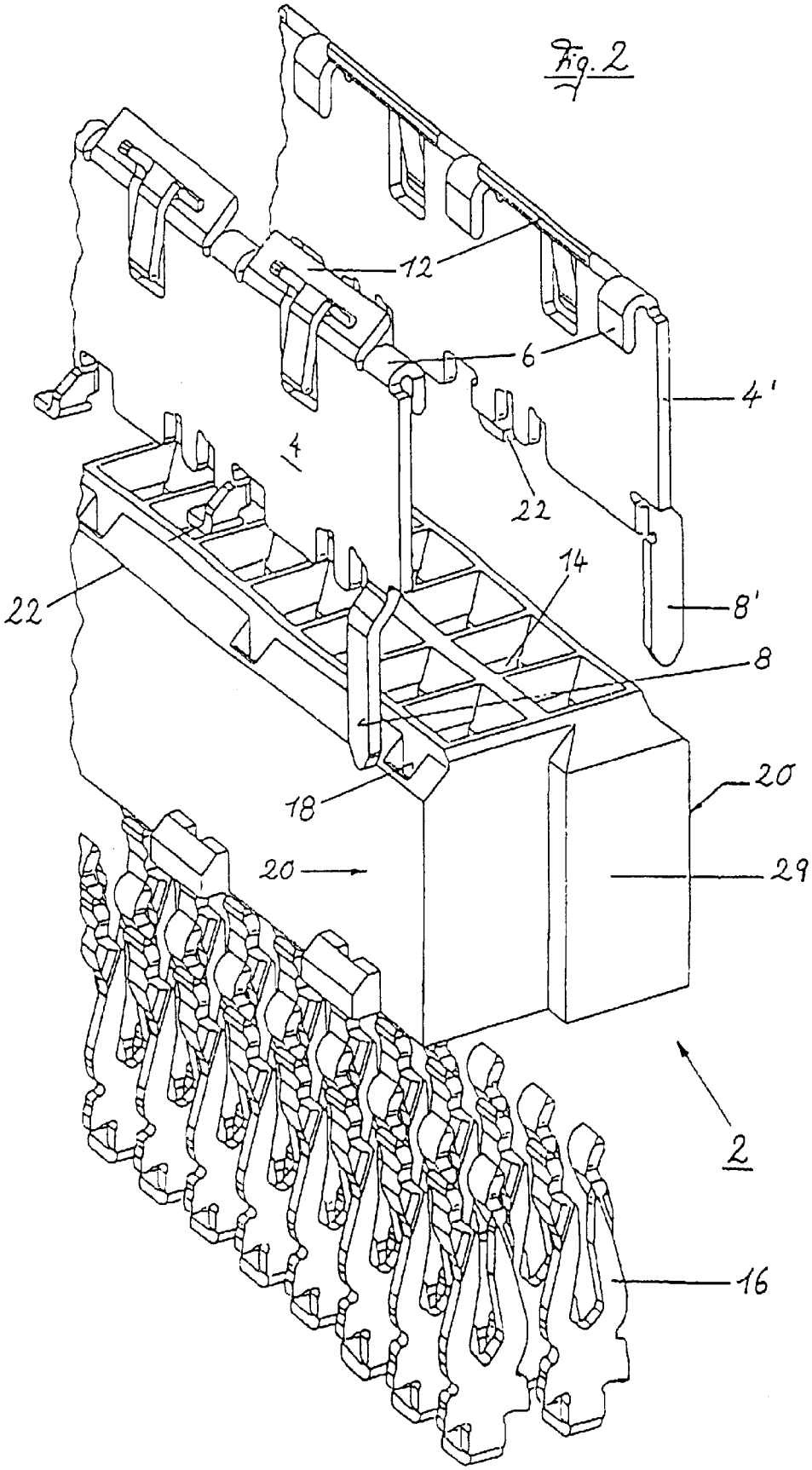
FIG. 2 shows an exploded diagram of an associated female multipoint connector, also with shield plate(s)

The substantially symmetric configuration of female multipoint connector 2 is evident from the diagram in FIG. 2. It is also formed by a body having side walls 20 and end faces 29 and provided with passages 14 through the bottom and top face of the body for positioning of sockets 16 and introduction of blades 15 during plug connection. Sockets 16 can also be fixed via a snap fastening. Shield plates 4, 4' bear directly against the exterior sides 20 of female multipoint connector 2, and soldering tags 8 are also formed on shield plates 4, 4'. Shield plates 4, 4' can be fixed with snap fastenings in the form of snap-in hooks 6, which can be shield in recesses 18 on female multipoint connector 2. Projections 12 are inclined toward the center, or in other words in the direction of the plane of symmetry of female multipoint connector 2, in order to achieve, as viewed in the longitudinal cross section relative to the longitudinal extent of female multipoint connector 2, conical or pyramidal tapering of projections 12.

Figure 3:
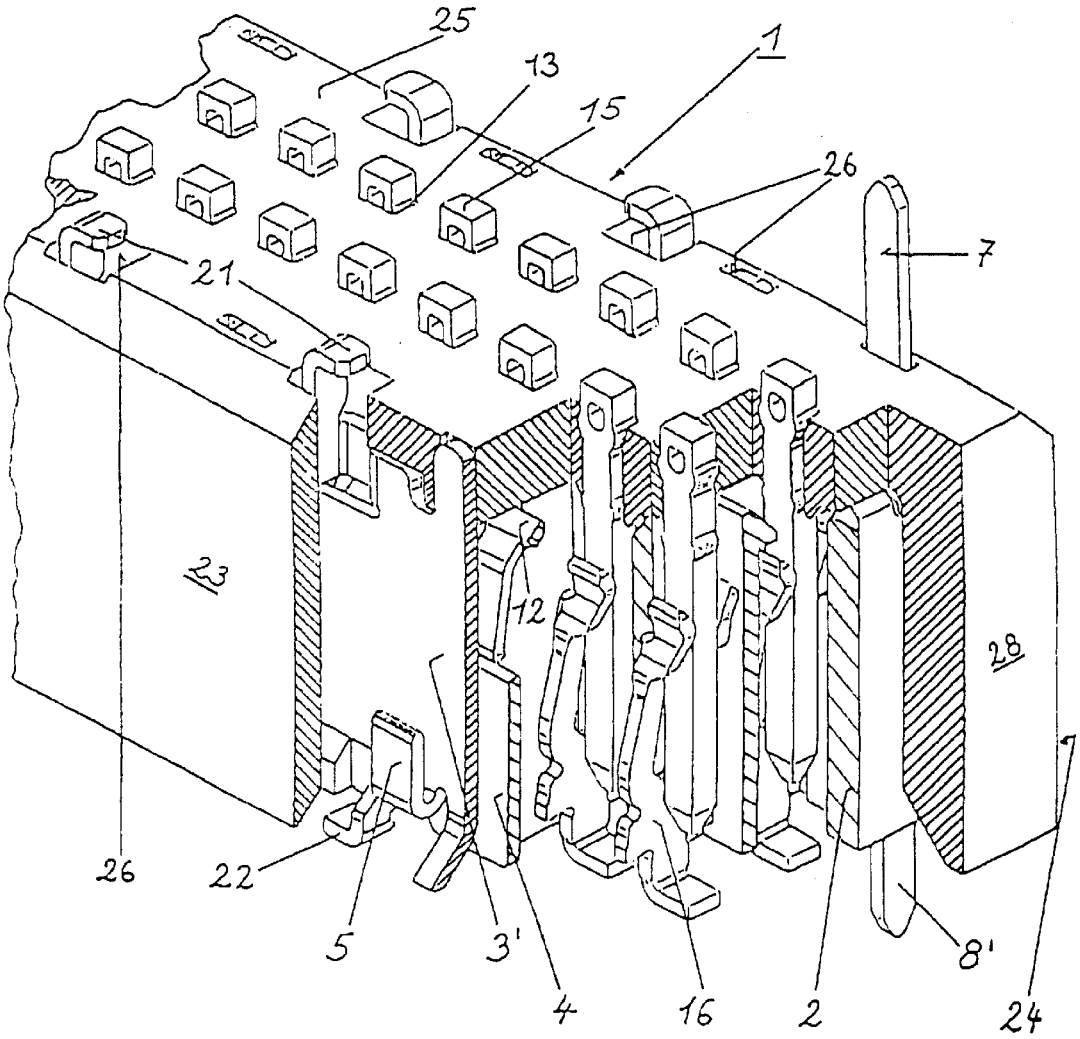
FIG. 3 shows a partially cutaway diagram of a plug connector comprising male and female multipoint connectors.

With SMD leads 22 it is possible to construct an SMD contact on, for example, a printed-circuit board or wiring board, in order to obtain a shield for such a connection. The partly cutaway diagram in FIG. 3 shows a plug connector comprising a male multipoint connector 1 and a female multipoint connector 2 in coupled condition. Blades 15 are in electrical contact with sockets 16. Shield plates 3, 4' and 3', 4 bear against one another over substantially their entire area in the coupled condition. The electrical contacting of shield plates 3, 3' and 4, 4' is accomplished via the associated soldering tags 7, 7' and 8, 8', which preferably extend beyond the respective bottoms of the plug connectors.

In further alternative embodiments of the invention not illustrated in FIGS. 1 to 3, shield plates 3, 3' and 4, 4' are of one-piece or multi-piece construction. In some cases it is advantageous for shield plates 3, 3' of male multipoint connector 1 and/or shield plates 4, 4' of female multipoint connector 2 respectively to be of common one-piece construction.

Accordingly, while at least one embodiment of the present invention has been shown and described, it is obvious that many changes and modifications may be made thereunto without departing from the spirit and scope of the invention.

In the claims:

1. A plug connector for connecting electronic devices, comprising:

a first plug-connector element;

a second plug-connector element that engages said first plug-connector element to form a coupled position;

a plurality of electrical signal conductors that provide electrical signal connections when said first plug-connector element and said second plug-connector element are in said coupled position;

at least one bonding conductor formed when said first plug-connector element and said second plug-connector element are in said coupled position;

at least one shield plate disposed on each said first plug-connector element and said second plug-connector element, wherein said at least one shield plate acts as an electrical shield and has a main plane;

a plurality of snap fastenings disposed on said first plug-connector element, said second plug-connector element and said at least one shield plate, wherein said plurality of snap fastenings detachably connect said at least one shield plate to each said first plug-connector element and said second plug-connector element in a snap fastened condition; and soldering tags disposed on said shield plates, wherein said soldering tags project out of said first plug-connector element and said second plug-connector element when said shield plates are in said snap-fastened condition;

wherein said at least one shield plate on each said first plug-connector element and said second plug-connector element bear against one another in a predominantly flush relationship when said first plug-connector element and said second plug-connector element are engaged in said coupled position.

2. A plug-connector according to claim 1, wherein:

said first plug-connector element is a male multipoint connector and said second plug-connector element is a female multipoint connector;

said male multipoint connector has a receiving cavity for said female multipoint connector and said at least one shield plate of said male multipoint connector is disposed on an inside of said receiving cavity; and said at least one shield plate of said female multipoint connector is disposed on an outside of said female multipoint connector.

3. A plug connector according to claim 1, further comprising a projection disposed on at least one of said shield plates, wherein said projection faces the other plug-connector element and can be engaged in a corresponding recess on the other plug-connector element.

4. A plug connector according to claim 1, wherein portions of said at least one shield plate, opposite said soldiering tag, are inclined out of said main plane of said shield plate, wherein said portions of said shield plate on said first plug-connector element are inclined in an opposite direction of said portions of said shield plate inclined on said second plug-connector element.

5. A plug connector according to claim 1, further comprising SMD plug connector elements formed on each of said shield plates, wherein said SMD plug connector elements electrically contact the respective shield plate with a wiring board or similar component, onto which that plug-connector element is plugged.

6. A plug connector according to claim 1, wherein said at least one shield plate is of one-piece construction.

7. A plug connector according to claim 1, wherein said at least one shield plate is of multi-piece construction.

8. A plug connector according to claim 2, wherein said at least on shield plate of said male multipoint connector and said at least one shield plate of said female multipoint connector are of common one-piece construction.

* * * * *